US010281226B2

(12) United States Patent
Liptak et al.

(10) Patent No.: US 10,281,226 B2
(45) Date of Patent: May 7, 2019

(54) TACTILE LOCK PLATE COMPONENTS AND METHODS

(71) Applicant: Magpul Industries Corp., Austin, TX (US)

(72) Inventors: Duane Liptak, Erie, CO (US); Yehezkel Eitan, Johnstown, CO (US)

(73) Assignee: Magpul Industries Corp., Austin, TX (US)

( * ) Notice: Subject to any disclaimer, the term of this patent is extended or adjusted under 35 U.S.C. 154(b) by 0 days.

(21) Appl. No.: 15/723,944

(22) Filed: Oct. 3, 2017

(65) Prior Publication Data

US 2019/0101347 A1 Apr. 4, 2019

(51) Int. Cl.
*F41A 9/65* (2006.01)
*F41A 11/00* (2006.01)

(52) U.S. Cl.
CPC ..... *F41A 9/65* (2013.01); *F41A 11/00* (2013.01)

(58) Field of Classification Search
CPC .... F41A 9/65; F41A 11/00; F41A 9/62; F41A 9/70
USPC ..... 42/17, 1.01, 18, 21, 22, 24, 29, 33, 35, 42/37, 7, 6, 49.01, 50, 49.1, 32, 11
See application file for complete search history.

(56) References Cited

U.S. PATENT DOCUMENTS 1,437,543 A 12/1922 Ortgies
3,377,732 A 4/1968 Bivens
3,485,431 A 12/1969 Wackrow
5,651,204 A 7/1997 Hulsey et al.
5,906,065 A 5/1999 Pearce
6,094,850 A * 8/2000 Villani ..... F41A 9/62 42/1.02
7,093,386 B1 8/2006 Vieweg
D769,397 S 10/2016 Lam et al.
9,784,513 B2 * 10/2017 Zimmer ..... F41A 9/62
2017/0191771 A1 * 7/2017 Zimmer ..... F41A 9/62

OTHER PUBLICATIONS

Elite Tactical Systems Group, "ETS AR15 Magazine R.R.S. (Rapid Recognition System)", "Retrieved from http://www.etsgroup.us/ETS-AR15-Magazine-R-R-S-Rapid-Recognition-System-p/ar-rrs.htm", Known to exist as early as Jun. 21, 2017, p. 2.
Hexmag, "Hexmag Hexid Color Identification System", "Retrieved from https://hexmag.com/rifle-ammunition-identification-system", Known to exist as early as Aug. 30, 2017, p. 4.
Magpul Industries, Corp., "PMAG 30 Ar/M4 GEN M3 5.56×45MM NATO", "Retreived from https://www.magpul.com/products/pmag-30-ar-m4-gen-m3", Known to exist as early as Aug. 30, 2017, p. 4 Published in: US.

* cited by examiner

*Primary Examiner* — John Cooper
(74) *Attorney, Agent, or Firm* — Neugeboren O'Dowd PC

(57) ABSTRACT

A lock system and related methods are disclosed. The lock mechanism has a lock plate configured to be positioned adjacent the distal side of a firearm floor plate. The lock plate has a base plate and a disengagement mechanism affixed to a proximal side of the base plate. The disengagement mechanism has a protrusion configured to extend into the passage of the floor plate when the floor plate and the lock plate abut one another. The protrusion has a first portion and a second portion. The first portion is shaped to extend into the passage of the floor plate. The second portion is shaped to extend through the passage of the floor plate and protrude from the proximal side of the floor plate.

20 Claims, 15 Drawing Sheets

TACTILE LOCK PLATE COMPONENTS AND METHODS

BACKGROUND

Field

The present invention relates generally to firearm magazines, and more specifically to lock plates for firearm magazines.

Background

Locking plates or lock plates may be provided with floor plates in firearm magazines. A user may depress a portion of the lock plate that extends through the floor plate so as to disengage the lock plate and enable the user to slide the floor plate from the magazine. From there, the user may completely disassemble the magazine for cleaning. There remains a need, however, for a lock plate that provides a user with the ability to distinguish different magazines or cartridges in particularly challenging environments.

SUMMARY

An exemplary lock mechanism for a firearm magazine has a lock plate to be positioned adjacent a distal side of a floor plate. The lock plate has a base plate and a disengagement mechanism affixed to a proximal side of the base plate, the disengagement mechanism having a protrusion configured to extend into the passage of the floor plate when the floor plate and the lock plate abut one another. The protrusion has a first portion and a second portion, the first portion to extend into the passage of the floor plate, the second portion to extend through the passage of the floor plate and protrude from the proximal side of the floor plate.

An exemplary identifying system for a firearm magazine is described, for a firearm magazine having a floor plate having a distal side, a proximal side, and a passage extending through the floor plate from the distal side through the proximal side. The exemplary system has a first lock mechanism for the firearm magazine, the first lock mechanism having a lock plate, the lock plate having a base plate and a disengagement mechanism affixed to a proximal side of the base plate. The disengagement mechanism has a protrusion configured to extend into the passage of the floor plate when the floor plate and the lock plate abut one another. The protrusion has a first portion and a second portion, the first portion to extend into the passage of the floor plate, the second portion to extend through the passage of the floor plate and protrude from the proximal side of the floor plate. The exemplary system has a second lock mechanism for the firearm magazine. The second lock mechanism has a lock plate, the lock plate having a base plate and a disengagement mechanism affixed to a proximal side of the base plate. The disengagement mechanism has a protrusion to extend into the passage of the floor plate when the floor plate and the lock plate abut one another. The protrusion has a first portion, a second portion, and a third portion. The first portion is to extend into the passage of the floor plate, and each of the second portion and the third portion are to extend through the passage of the floor plate and protrude from the proximal side of the floor plate.

An exemplary method includes providing an identifying system for a firearm magazine, the firearm magazine having a floor plate having a distal side, a proximal side, and a passage extending through the floor plate from the distal side through the proximal side, the system having: (a) a first lock mechanism for the firearm magazine, the first lock mechanism comprising a lock plate, the lock plate having a base plate and a disengagement mechanism affixed to a proximal side of the base plate, the disengagement mechanism having a protrusion configured to extend into the passage of the floor plate when the floor plate and the lock plate abut one another, and wherein the protrusion has a first portion and a second portion, the first portion configured to extend into the passage of the floor plate, the second portion configured to extend through the passage of the floor plate and protrude from the proximal side of the floor plate; and (b) a second lock mechanism for the firearm magazine, the second lock mechanism comprising a lock plate, the lock plate having a base plate and a disengagement mechanism affixed to a proximal side of the base plate, the disengagement mechanism having a protrusion configured to extend into the passage of the floor plate when the floor plate and the lock plate abut one another, and wherein the protrusion has a first portion, a second portion, and a third portion, the first portion configured to extend into the passage of the floor plate, each of the second portion and the third portion configured to extend through the passage of the floor plate and protrude from the proximal side of the floor plate. The exemplary method also includes positioning the first lock mechanism in the firearm magazine to identify a first cartridge type; and at least one of (a) replacing the first lock mechanism with the second lock mechanism to identify a second cartridge type, or (b) positioning the second lock mechanism in a second firearm magazine to identify a second cartridge type.

An exemplary identifying system for a firearm magazine has a first lock plate and a second lock plate, each of the first and second lock plates having a base plate and a disengagement mechanism. Each disengagement mechanism has a protrusion. Each protrusion has a first portion and a second portion, the first portion configured to extend a first distance from the base plate, and the second portion configured to extend a second distance from the base plate, the second distance greater than the first distance. The protrusion of one of the first or second lock plates has a third portion, the third portion configured to extend a third distance from the base plate, the third distance greater than the first distance.

DETAILED DESCRIPTION

Those skilled in the art or firearms industry are aware of the use of locking plates or lock plates with floor plates in firearm magazines. For example, a user may depress a portion of the lock plate that extends through the floor plate so as to disengage the lock plate and enable the user to slide the floor plate from the magazine. From there, the user may completely disassemble the magazine for cleaning. The skilled person is also aware that, in some cases, a particular style of firearm magazine may house more than one type of cartridge. Here, a user may wish to identify a particular cartridge type in a firearm magazine, or distinguish a first cartridge type in a firearm magazine from a second cartridge type in the same or a similar firearm magazine. For example, a user may wish to provide a first magazine with blank ammunition and a second magazine with live cartridges, or a user may wish to provide a first magazine with cartridges suitable for a first particular use (e.g. long range) and a second magazine with cartridges suitable for a second particular use (e.g. long range). In other examples, a user may simply wish to distinguish cartridges of different brands, or a user may wish to distinguish a magazine that has been in storage for a different period of time, or any other difference in characteristics between two or more magazines or cartridges therein. In some examples, a user may wish to identify the different cartridges tactilely, such as when the user is operating in the dark. For example, the user may be wearing gloves while working with limited light or space, may not have access to tools, and/or may need to respond quickly without diverting attention.

To name a few non-limiting examples, those skilled in the art will recognize that commercial ammunition often does not include any standardized markings, despite a plethora of variations—even within a given caliber (bullet weight/type/shape/materials/coatings, tolerancing (standard vs. match), intended purpose (self-defense, training, recreation, various specialized hunting types), manufacturer, etc.

Other uses or variances, such as for military use, include identifying different ammunition types such as Ball, Tracer, Armor Piercing, Frangible or Match (Long Range or Special Purpose). Civilian uses include denoting different manufactures and other uses as previously mentioned.

Those skilled in the art are also aware that, although military ammunition types are typically readily identifiable visually, the magazines are usually carried upside down, and thus the loaded rounds are concealed in load-bearing gear/pouches.

To meet one or more of these needs, the Applicants describe herein a lock plate and/or lock mechanism and system, and method therefore.

Figure 1:
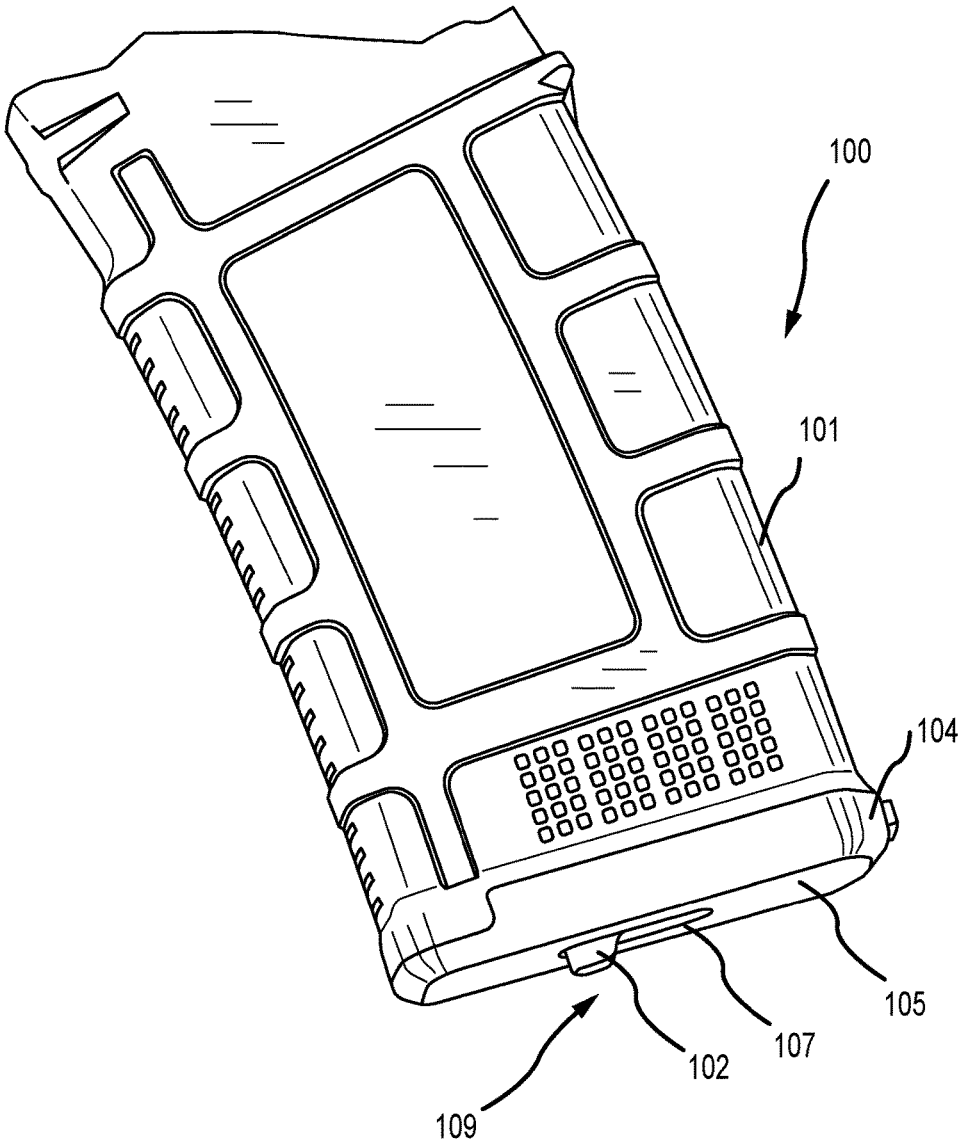
FIG. 1 is a lower perspective view of a firearm magazine with a lock plate.
Figure 2:
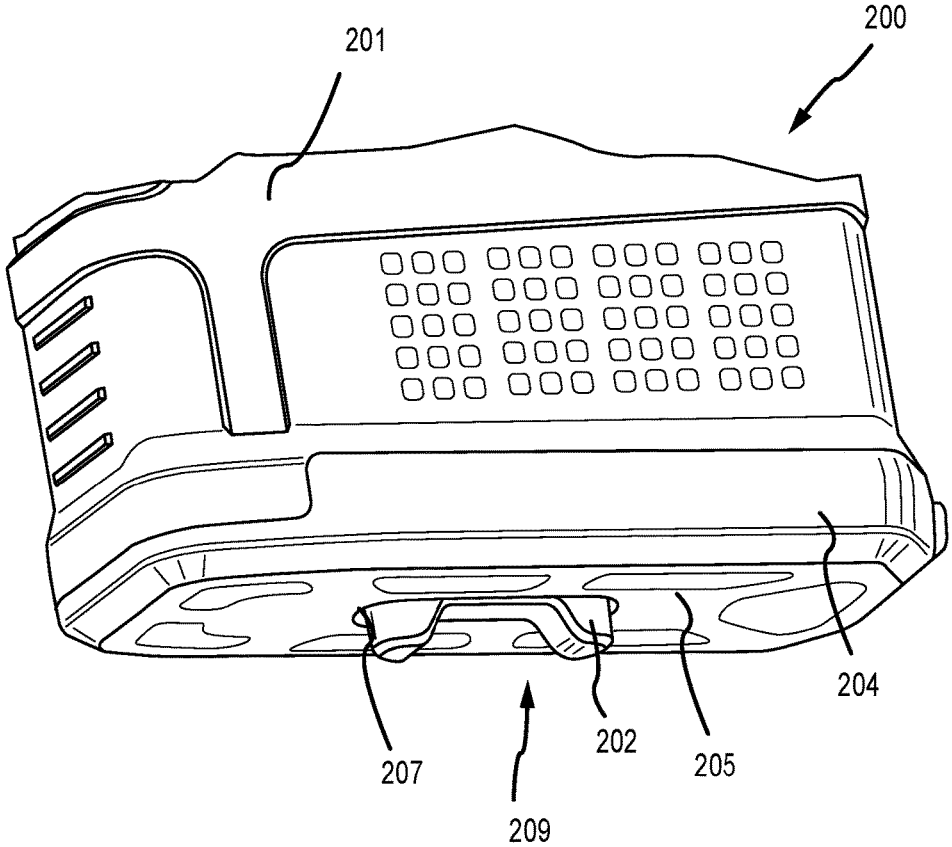
FIG. 2 is a lower perspective view of a firearm magazine with a lock plate.
Figure 3:
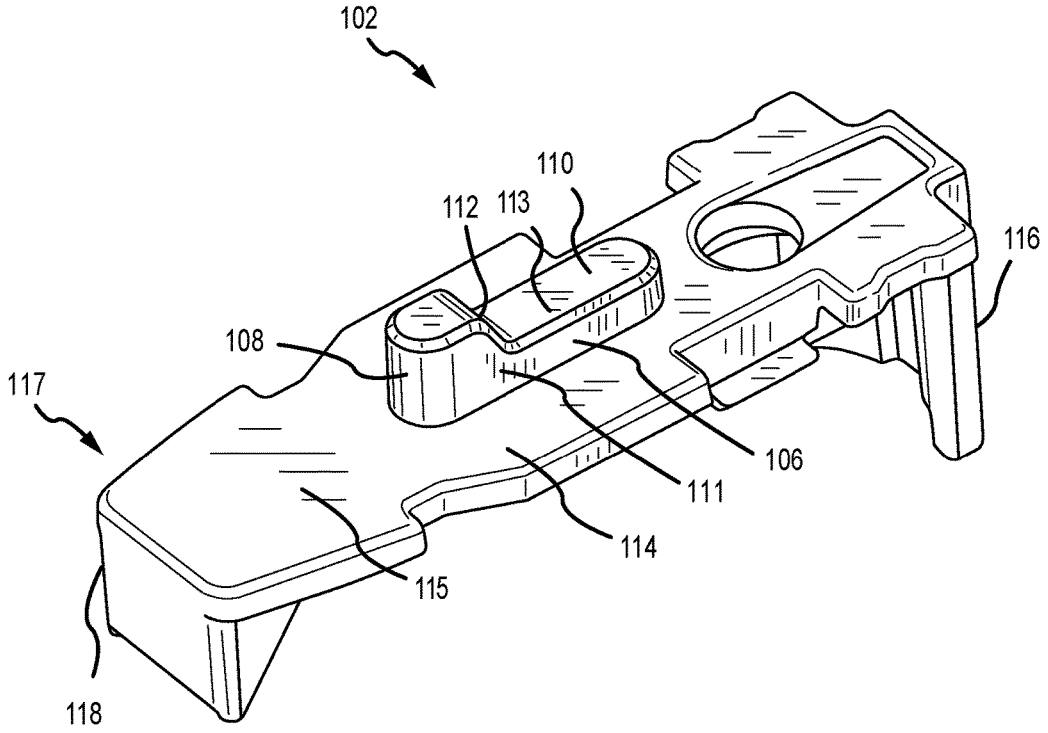
FIG. 3 is a perspective view of a lock plate.
Figure 4:
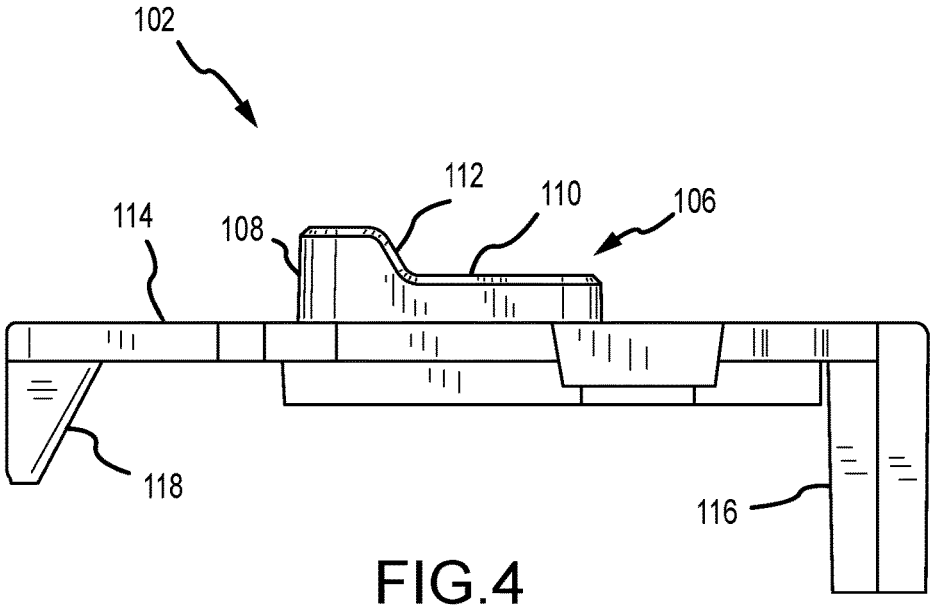
FIG. 4 is a first side view of the lock plate in FIG. 3.
Figure 5:
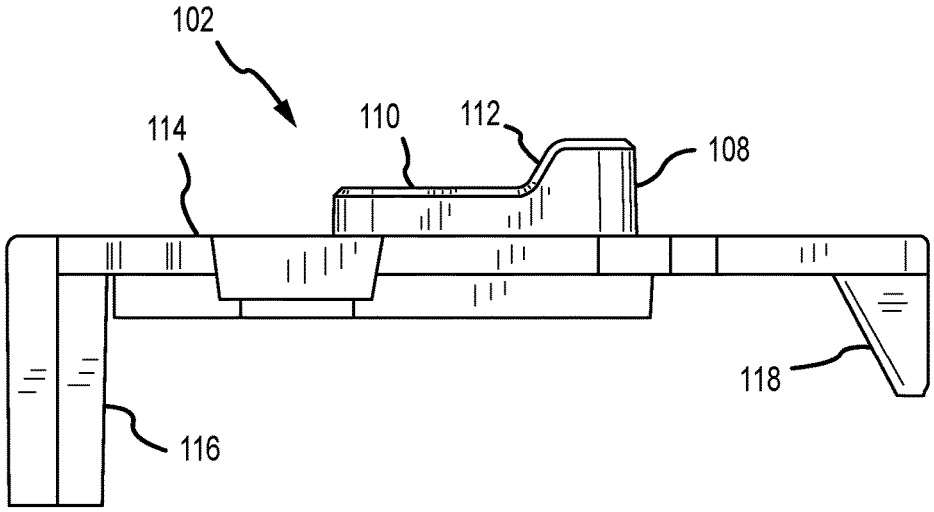
FIG. 5 is a second side view of the lock plate in FIG. 3.
Figure 6:
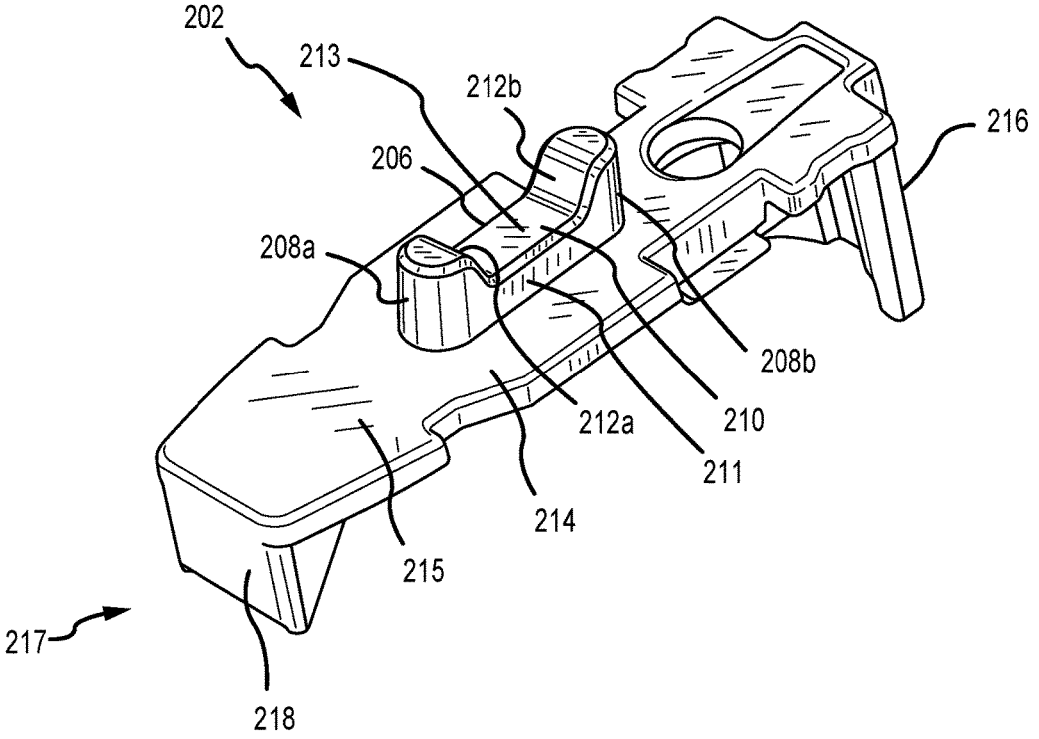
FIG. 6 is a perspective view of a lock plate.
Figure 7:
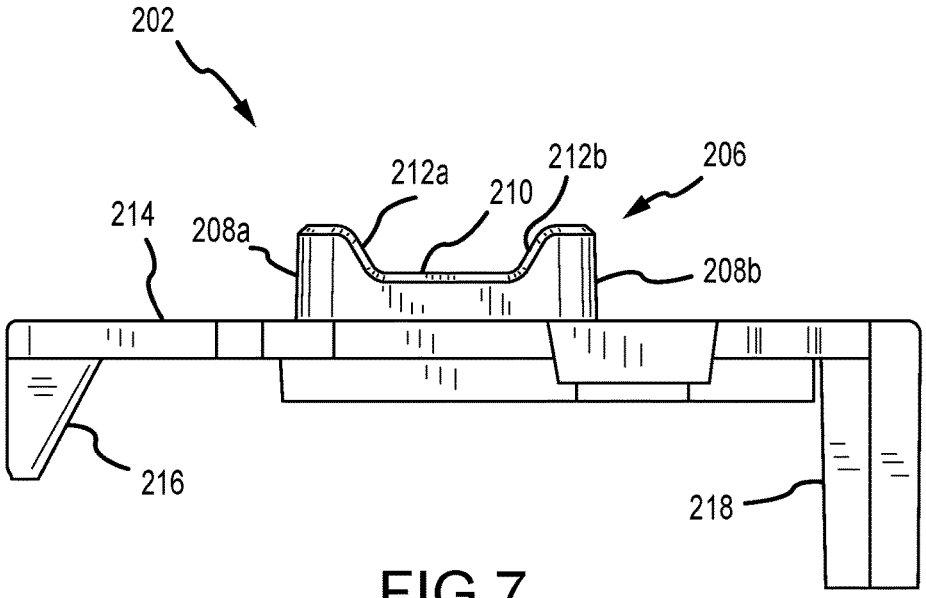
FIG. 7 is a first side view of the lock plate in FIG. 6.
Figure 8:
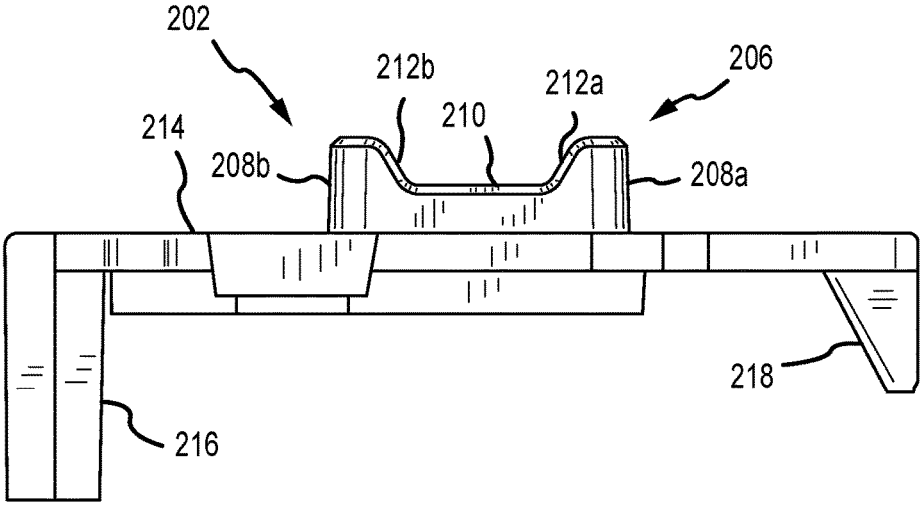
FIG. 8 is a second side view of the lock plate in FIG. 6.
Figure 9:
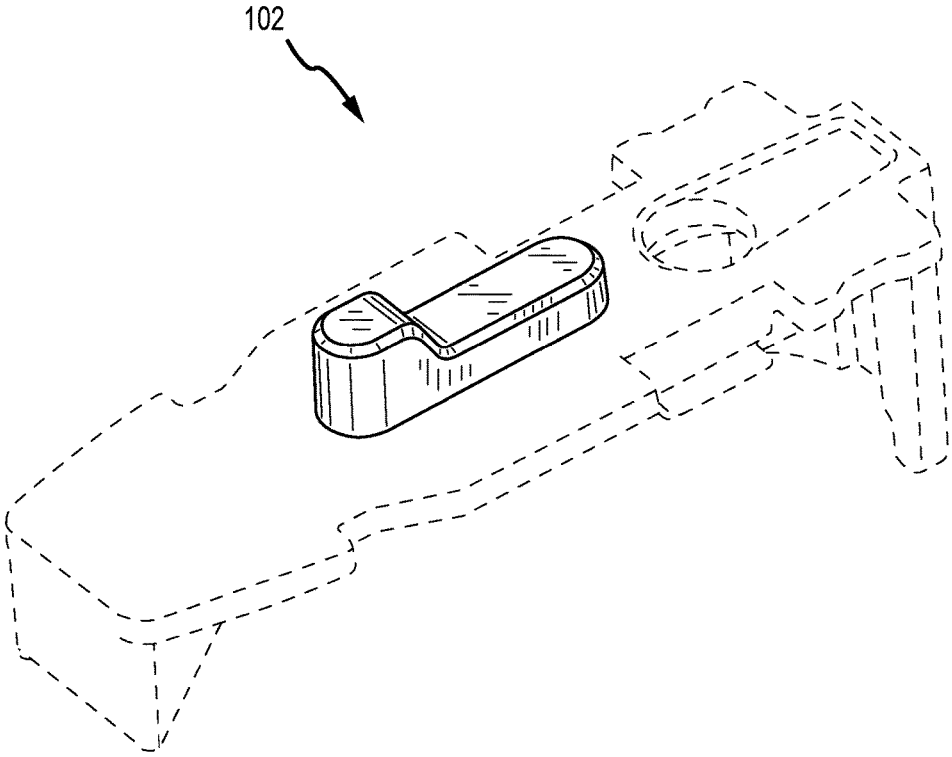
FIG. 9 is a perspective of a lock mechanism on a lock plate.
Figure 10:
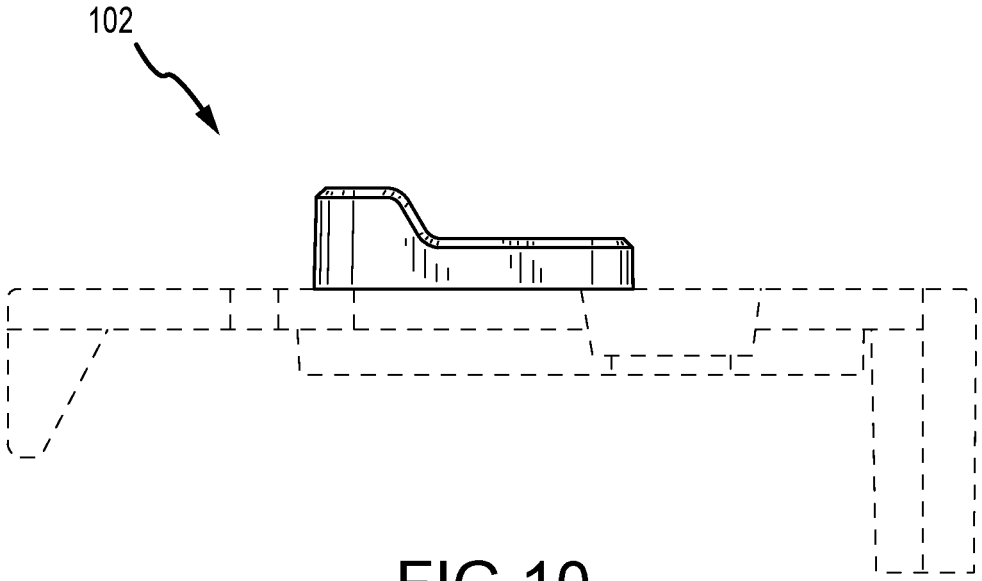
FIG. 10 is a first side view of the lock mechanism in FIG. 9.
Figure 11:
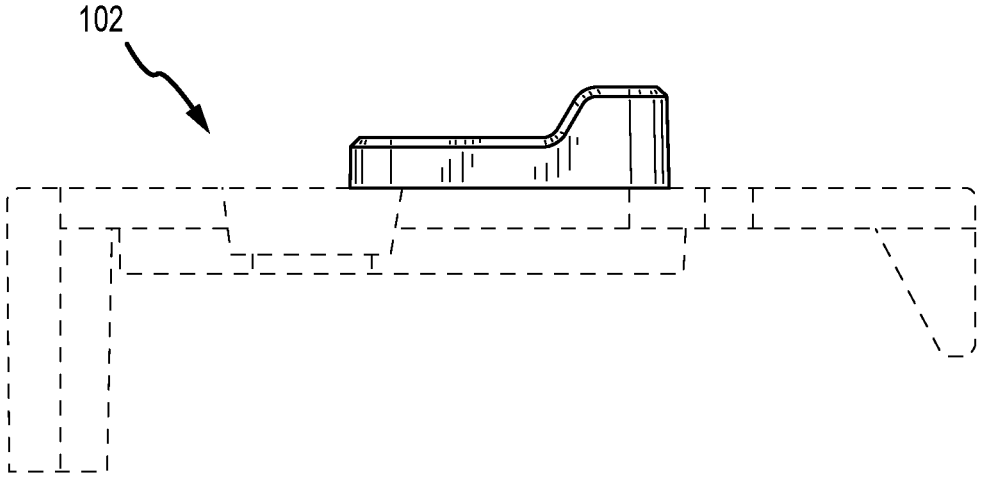
FIG. 11 is a second side view of the lock mechanism in FIG. 9.
Figure 12:
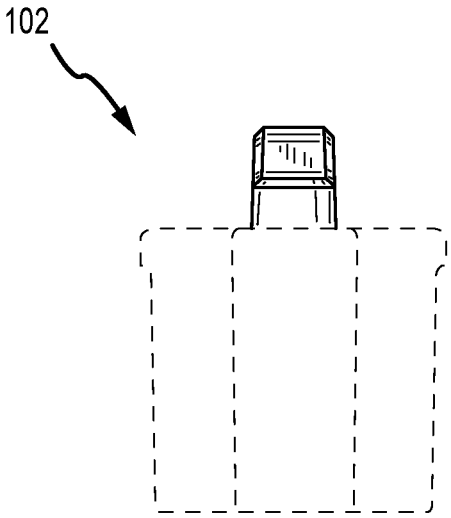
FIG. 12 is a back view of the lock mechanism in FIG. 9.
Figure 13:
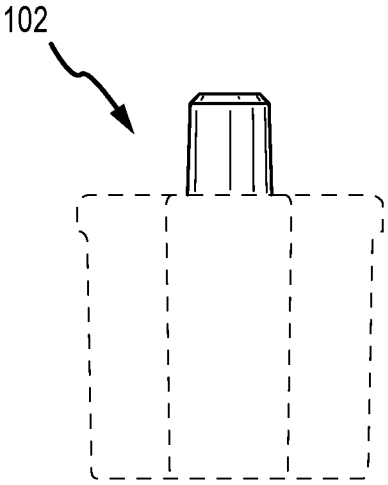
FIG. 13 is a front view of the lock mechanism in FIG. 9.
Figure 14:
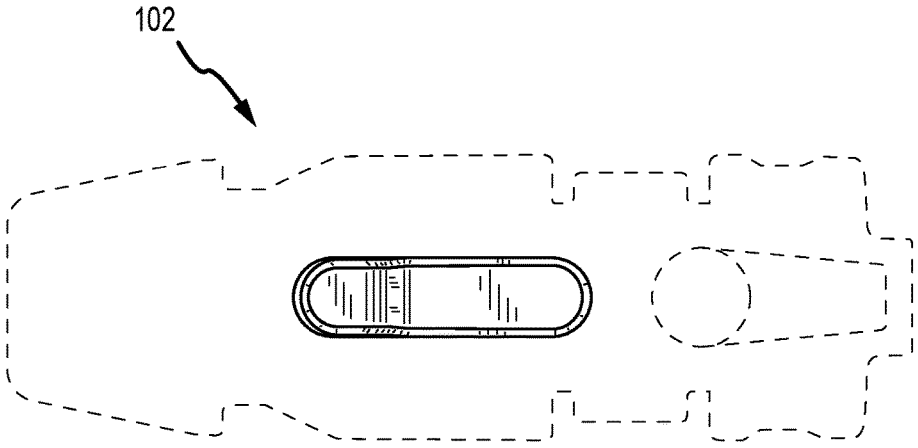
FIG. 14 is a bottom view of the lock mechanism in FIG. 9.
Figure 15:
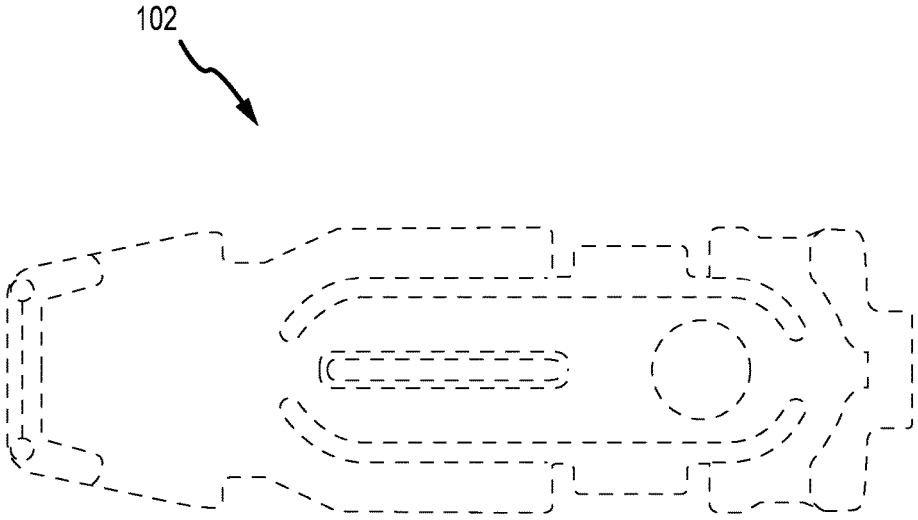
FIG. 15 is a top view of the lock mechanism in FIG. 9.
Figure 16:
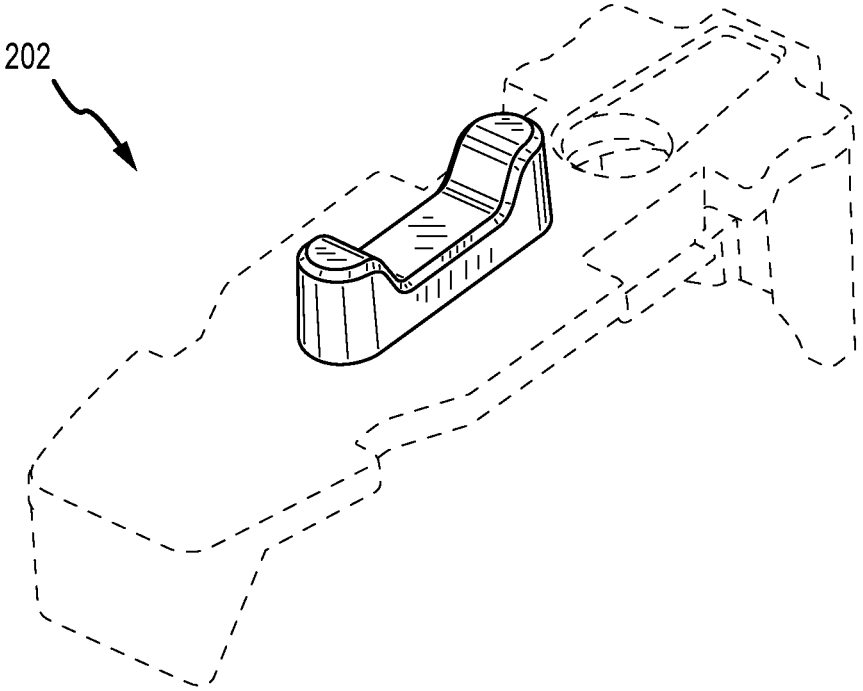
FIG. 16 is a perspective of a lock mechanism on a lock plate.
Figure 17:
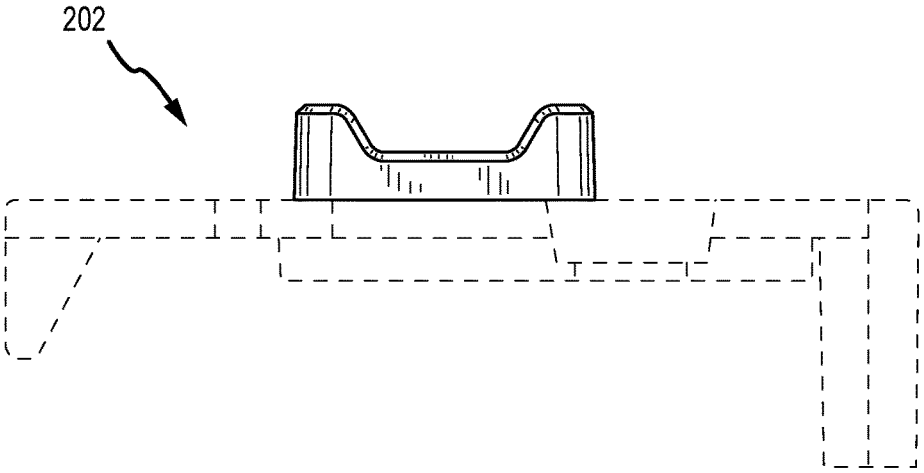
FIG. 17 is a first side view of the lock mechanism in FIG. 16.
Figure 18:
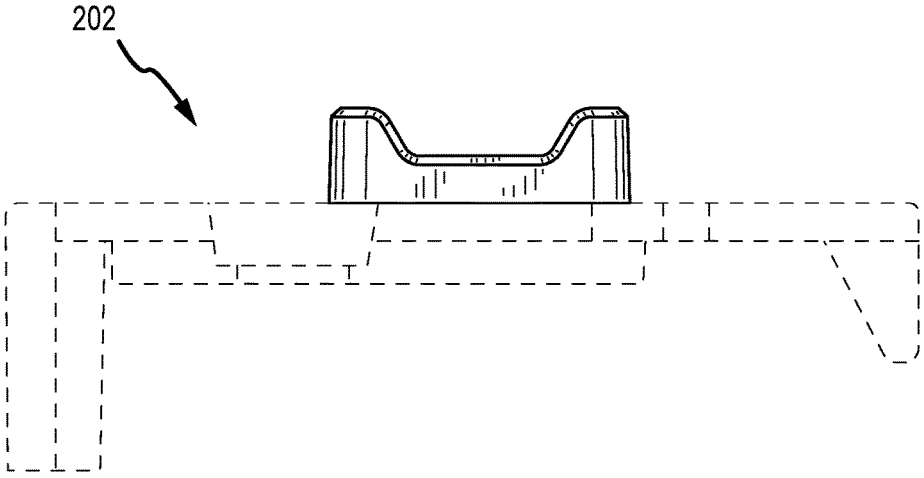
FIG. 18 is a second side view of the lock mechanism in FIG. 16.
Figure 19:
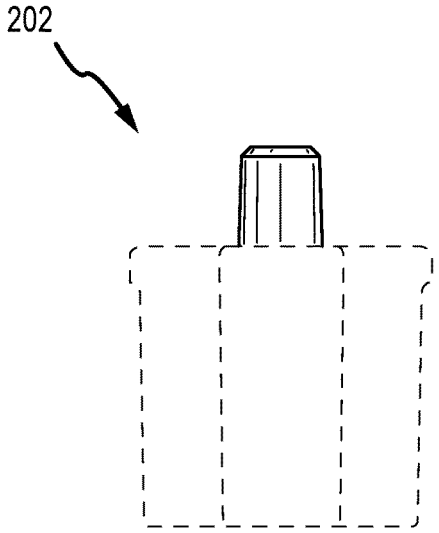
FIG. 19 is a back view of the lock mechanism in FIG. 16.
Figure 20:
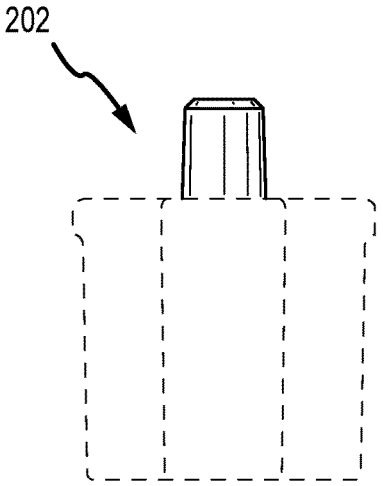
FIG. 20 is a front view of the lock mechanism in FIG. 16.
Figure 21:
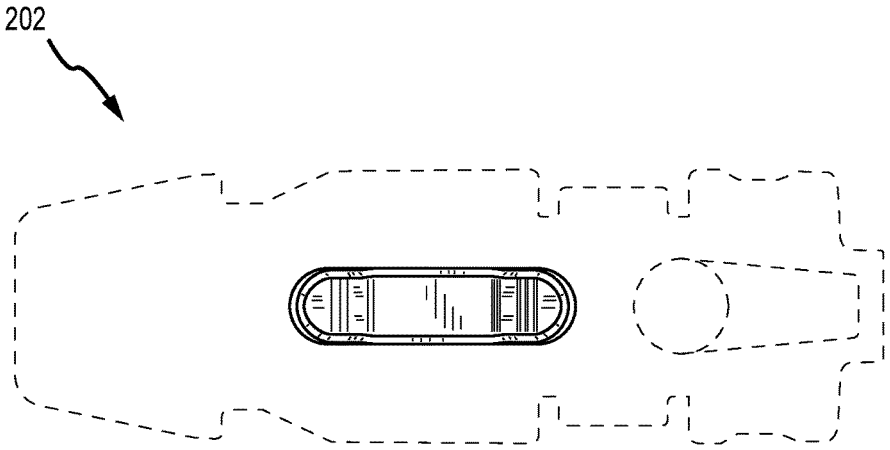
FIG. 21 is a view of the lock mechanism in FIG. 16.
Figure 22:
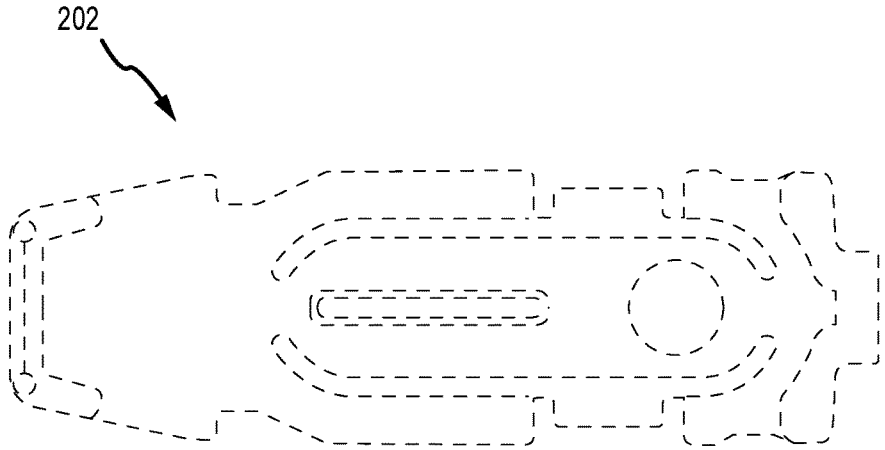
FIG. 22 is a bottom view of the lock mechanism in FIG. 16.

As illustrated in FIGS. 1 and 2, a magazine assembly 100, 200 may include a magazine housing 101, 201, a lock plate 102, 202, and a floor plate 104, 204. The floor plate 104, 204 may have a distal side (not illustrated) associated with an interior of the magazine housing 101, 201 and a proximal side 105, 205 associated with an exterior of the housing 101, 201, and a passage 107, 207 extending through the floor plate 104, 204 from the distal side through the proximal side 105, 205. That is, the floor plate 104, 204 may have a passage 107, 207 that extends from the exterior of the magazine assembly 100, 200 to an interior of the magazine assembly 100, 200. The assembly 100, 200 may have a lock mechanism 109, 209 that includes a lock plate 102, 202 positioned adjacent the distal side of the floor plate 104, 204.

The tactile lock plate 102, 202 illustrated in FIGS. 1-2 is located on the bottom of the magazine assembly 100, 200, and is thus useful as a visible and tactile identifier in this position without extracting the magazine assembly 100, 200 from a pouch (not illustrated) such as those carried by military personnel. In some embodiments, the tactile lock plate 102, 202 can be used to identify or distinguish amongst the various commercial ammunition that is not typically identified.

With reference now to FIGS. 3-8, the lock plate 102, 202 may have a base plate 114, 214 and a disengagement mechanism 106, 206 affixed to a proximal side 115, 215 of the base plate 114, 214. The disengagement mechanism 106, 206 may have a protrusion 111, 211 that extends into or is configured to extend into the passage 107, 207 (see e.g. FIG. 1) of the floor plate 104, 204 when the floor plate 104, 204 and the lock plate 102, 202 abut one another.

Continuing with FIGS. 3-8, the protrusion 111, 211 may have a first portion 110, 210 and a second portion 108, 208*a*. The first portion 110, 210 may extend into or may be configured to extend into the passage 107, 207 (see FIG. 1) of the floor plate 104, 204. The second portion 108, 208*a* may extend through or may be configured to extend through the passage 107, 207 of the floor plate 107, 207 such that the second portion 108, 208*a* protrudes from the proximal side 105, 205 of the floor plate 104, 204.

In some embodiments, the first portion 110, 210 may have a disengagement surface 113, 213. At least a portion of the disengagement surface 113, 213 may be substantially parallel with the proximal side 115, 215 of the base plate 114, 214 of the lock plate 102, 202. In some embodiments, at least a portion of the disengagement surface 113, 213 may be co-axial with an axis of intended travel or movement of the lock plate 102, 202 relative to the housing 101, 201.

In some embodiments, at least a portion of the disengagement mechanism 106, 206 is positioned on a center portion of the base plate 114, 214. In some embodiments, the disengagement mechanism 106, 206 is made of the same material as the base plate 114, 214. In some embodiments, the disengagement mechanism 106, 206 is more malleable or resilient than the base plate 114, 214. The disengagement mechanism 106, 206 may be unitary with the base plate 114, 214 in some embodiments, or the disengagement mechanism 106, 206 may be coupled to the base plate 114, 214.

In some embodiments, the first portion 110, 210 and the second portion 108, 208*a* are separated by a surface 112, 212 that is parallel to neither the first portion 110, 210 nor the second portion 108, 208*a*.

In some embodiments, the second portion 108, 208 is positioned forward of the first portion 110, 210. A forward direction or region may be a region 117, 217 that is associated with a firing direction of a firearm associated with the magazine assembly 100, 200.

With reference now to FIG. 2 and FIGS. 6-8, in some embodiments, the protrusion 211 may have a first portion 210 and a second portion 208*a* substantially as previously described herein, as well as a third portion 208*b*. The third portion 208*b* may extend through or may be configured to extend through the passage 207 of the floor plate 204 and protrude from the proximal side 2 of the floor plate 204.

The first portion 210 of the protrusion 211 or disengagement mechanism 206 may be positioned between the second portion 208*a* and the third portion 208*b*. In some embodiments, the first portion 210 and the third portion 208*b* may be separated by a surface 212*b* that is parallel to neither the first portion 210 nor the third portion 208*b*.

In some embodiments, an identifying system for a firearm magazine may be provided. The system may include, for example, two or more lock mechanisms 109, 209 or lock plates 102, 202, such as those illustrated in FIGS. 1 and 2 and previously described herein. The identifying system may be configured to provide a user who is wearing gloves with an ability to tactilely distinguish between two magazine assemblies 100, 200. For example, the lock plates 102, 202 may have identifying features or portions 108, 208*a*, 208*b* that protrude far enough past a floor plate 104, 204 that a user may feel the protruding portions 108, 208*a*, 208*b* easily, even while wearing gloves. The portions 108, 208*a*, 208*b* may extend beyond the floor plate 104, 204 a distance of at least one-third the thickness of the floor plate 104, 204. In some embodiments, one or more of the portions 108, 208*a*, 208*b* may extend beyond the floor plate 104, 204 a distance of 5 millimeters or more. In some embodiments, one or more of the portions 108, 208*a*, 208*b* may extend beyond the floor plate 104, 204 a distance of 10 millimeters or more. In some embodiments, one or more of the portions 108, 208*a*, 208*b* may extend beyond the floor plate 104, 204 a distance of 15 millimeters or more. In some embodiments, the second portion 208*a* may extend beyond the floor plate 204 a distance that is different from the distance of extension by the third portion 208*b*.

In some embodiments, and with reference to FIGS. 3-8, an identifying system for a firearm magazine may have a first lock 102 plate and a second lock plate 102, each of the first and second lock plates 102, 202 having a base plate 114, 214 and a disengagement mechanism 109, 209. Each disengagement mechanism 109, 209 may have a protrusion 111, 211. Each protrusion 111, 211 may have a first portion 110, 210 and a second portion 108, 208*a*. The first portion 108, 208*a* may be configured to extend a first distance from the base plate 114, 214, and the second portion 108, 208*a* may be configured to extend a second distance from the base plate 114, 214, the second distance greater than the first distance. The protrusion 111, 211 of one of the first or second lock plates 102, 202 has a third portion 208*b*. The third portion 208*b* may be configured to extend a third distance from the base plate 214, the third distance greater than the first distance.

Other features of the system may be substantially similar to the identifying system previously described herein.

With reference now to FIGS. 9-22, embodiments of a lock mechanism for a lock plate 102, 202 are illustrated. The lock mechanism may have one or two raised features including surface treatments substantially as shown.

In terms of the aesthetic features, those skilled in the art will recognize that the features may be broken at natural features of the device. For example, the lock mechanism in FIGS. 9-22 may include some surface features of the lock plate 102, 202, or may include the entire lock plate 102, 202 previously described herein.

Figure 23:
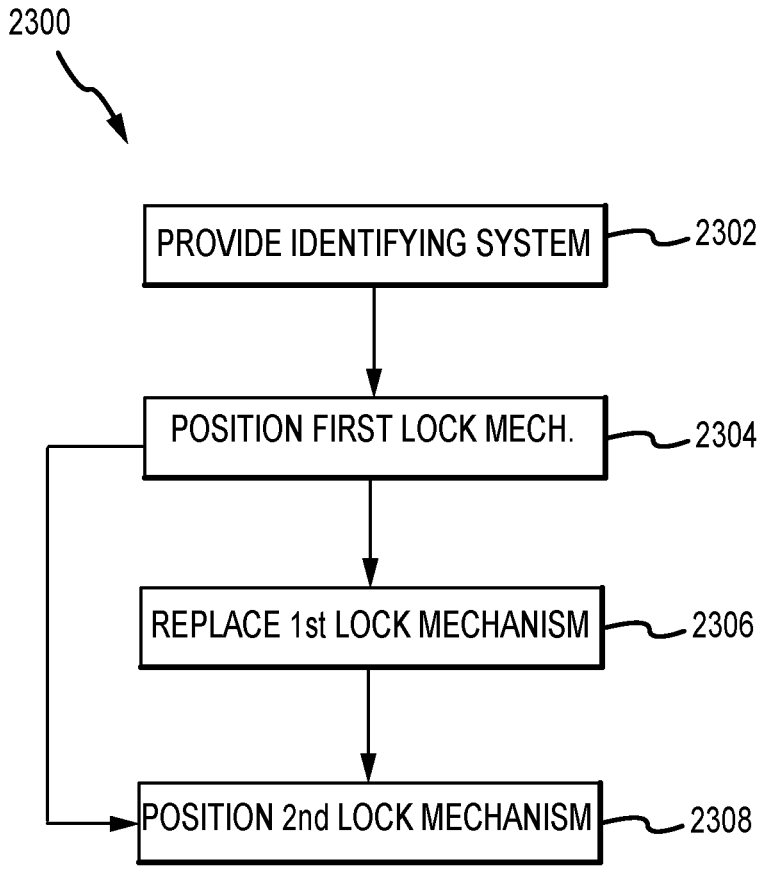
FIG. 23 is a flowchart of a method.

In some embodiments, and with reference now to FIG. 23, a method 2300 is described. The method 2300 may include providing 2302 an identifying system for a firearm magazine. The identifying system may be substantially similar to the identifying system previously described herein.

The method 2300 may also include positioning 2304 the first lock mechanism in the firearm magazine to identify a first cartridge type. Positioning 2304 may be achieved by assembling the first lock mechanism substantially as illustrated in FIG. 1 or FIG. 2.

The method 2300 may also include replacing 2306 the first lock mechanism with the second lock mechanism to identify a second cartridge type, and/or positioning 2308 the second lock mechanism in a second firearm magazine to identify a second cartridge type.

The terms and expressions employed herein are used as terms and expressions of description and not of limitation, and there is no intention, in the use of such terms and expressions, of excluding any equivalents of the features shown and described or portions thereof. Each of the various elements disclosed herein may be achieved in a variety of manners. This disclosure should be understood to encompass each such variation, be it a variation of an embodiment of any apparatus embodiment, a method or process embodiment, or even merely a variation of any element of these. Particularly, it should be understood that the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled.

As but one example, it should be understood that all action may be expressed as a means for taking that action or as an element which causes that action. Similarly, each physical element disclosed should be understood to encompass a disclosure of the action which that physical element facilitates. Regarding this last aspect, by way of example only, the disclosure of a "protrusion" should be understood to encompass disclosure of the act of "protruding"—whether explicitly discussed or not—and, conversely, were there only disclosure of the act of "biasing", such a disclosure should be understood to encompass disclosure of a "biasing mechanism". Such changes and alternative terms are to be understood to be explicitly included in the description.

The previous description of the disclosed embodiments and examples is provided to enable any person skilled in the art to make or use the present invention as defined by the claims. Thus, the present invention is not intended to be limited to the examples disclosed herein. Various modifications to these embodiments will be readily apparent to those skilled in the art, and the generic principles defined herein may be applied to other embodiments without departing from the spirit or scope of the invention as claimed.

The invention claimed is:

1. A lock mechanism for a firearm magazine, the firearm magazine having a floor plate having a distal side, a proximal side, and a passage extending through the floor plate from the distal side through the proximal side, the lock mechanism comprising:

a lock plate configured to be positioned adjacent the distal side of the floor plate, the lock plate having a base plate and a disengagement mechanism affixed to a proximal side of the base plate, the disengagement mechanism having a protrusion configured to extend into the passage of the floor plate when the floor plate and the lock plate abut one another; and wherein the protrusion has a first portion, a second portion, and a third portion, the first portion configured to extend into the passage of the floor plate, the second portion configured to extend through the passage of the floor plate and protrude from the proximal side of the floor plate, and the third portion configured to extend through the passage of the floor plate and protrude from the proximal side of the floor plate.

2. The lock mechanism of claim 1, wherein:

the first portion of the protrusion has a disengagement surface, at least a portion of the disengagement surface substantially parallel with the proximal side of the base plate of the lock plate.

3. The lock mechanism of claim 1, wherein:

the first portion and the second portion are separated by a surface that is parallel to neither the first portion nor the second portion.

4. The lock mechanism of claim 1, wherein:

the second portion of the protrusion is positioned forward of the first portion.

5. The lock mechanism of claim 1, wherein:

the first portion of the protrusion is positioned between the second portion and the third portion.

6. The lock mechanism of claim 1, wherein:

the first portion and the third portion are separated by a surface that is parallel to neither the first portion nor the third portion.

7. An identifying system for a firearm magazine, the firearm magazine having a floor plate having a distal side, a proximal side, and a passage extending through the floor plate from the distal side through the proximal side, the system comprising:

a first lock mechanism for the firearm magazine, the first lock mechanism comprising:

a lock plate, the lock plate having a base plate and a disengagement mechanism affixed to a proximal side of the base plate, the disengagement mechanism having a protrusion configured to extend into the passage of the floor plate when the floor plate and the lock plate abut one another, and wherein the protrusion has a first portion a second portion, the first portion configured to extend into the passage of the floor plate, the second portion configured to extend through the passage of the floor plate and protrude from the proximal side of the floor plate; and a second lock mechanism for the firearm magazine, the second lock mechanism comprising:

a lock plate, the lock plate having a base plate and a disengagement mechanism affixed to a proximal side of the base plate, the disengagement mechanism having a protrusion configured to extend into the passage of the floor plate when the floor plate and the lock plate abut one another, and wherein the protrusion has a first portion, a second portion, and a third portion, the first portion configured to extend into the passage of the floor plate, each of the second portion and the third portion configured to extend through the passage of the floor plate and protrude from the proximal side of the floor plate.

8. The system of claim 7, wherein:

the first portion of at least one of the first or second lock mechanisms has a disengagement surface, at least a portion of the disengagement surface substantially parallel with the proximal side of the base plate of the at least one of the first or second lock mechanism.

9. The system of claim 7, wherein:

the first portion and the second portion of at least one of the first or second lock mechanisms are separated by a surface that is parallel to neither the first portion nor the second portion.

10. The system of claim 7, wherein:

the second portion of the protrusion in at least one of the first or second lock mechanisms is positioned forward of the first portion.

11. The system of claim 7, wherein:

in the second lock mechanism, the first portion of the protrusion is positioned between the second portion and the third portion.

12. The system of claim 11, wherein:

the first portion and the third portion of the second lock mechanism are separated by a surface that is parallel to neither the first portion nor the third portion.

13. A method, comprising:

providing an identifying system for a firearm magazine, the firearm magazine having a floor plate having a distal side, a proximal side, and a passage extending through the floor plate from the distal side through the proximal side, the system comprising: (a) a first lock mechanism for the firearm magazine, the first lock mechanism comprising a lock plate, the lock plate having a base plate and a disengagement mechanism affixed to a proximal side of the base plate, the disengagement mechanism having a protrusion configured to extend into the passage of the floor plate when the floor plate and the lock plate abut one another, and wherein the protrusion has a first portion a second portion, the first portion configured to extend into the passage of the floor plate, the second portion configured to extend through the passage of the floor plate and protrude from the proximal side of the floor plate; and (b) a second lock mechanism for the firearm magazine, the second lock mechanism comprising a lock plate, the lock plate having a base plate and a disengagement mechanism affixed to a proximal side of the base plate, the disengagement mechanism having a protrusion configured to extend into the passage of the floor plate when the floor plate and the lock plate abut one another, and wherein the protrusion has a first portion, a second portion, and a third portion, the first portion configured to extend into the passage of the floor plate, each of the second portion and the third portion configured to extend through the passage of the floor plate and protrude from the proximal side of the floor plate;

positioning the first lock mechanism in the firearm magazine to identify a first cartridge type; and at least one of replacing the first lock mechanism with the second lock mechanism to identify a second cartridge type, or positioning the second lock mechanism in a second firearm magazine to identify a second cartridge type.

14. A lock mechanism for a firearm magazine, the firearm magazine having a floor plate having a distal side, a proximal side, and a passage extending through the floor plate from the distal side through the proximal side, the lock mechanism comprising:

a lock plate configured to be positioned adjacent the distal side of the floor plate, the lock plate having a base plate and a disengagement mechanism affixed to a proximal side of the base plate, the disengagement mechanism having a protrusion configured to extend into the passage of the floor plate when the floor plate and the lock plate abut one another; and wherein the protrusion has a first portion and a second portion, the first and second portions having a fixed relationship to each other, the first portion configured to extend into the passage of the floor plate, the second portion configured to extend through the passage of the floor plate and protrude from the proximal side of the floor plate.

15. The lock mechanism of claim 14, wherein:

the first portion of the protrusion has a disengagement surface, at least a portion of the disengagement surface substantially parallel with the proximal side of the base plate of the lock plate.

16. The lock mechanism of claim 14, wherein:

the first portion and the second portion are separated by a surface that is parallel to neither the first portion nor the second portion.

17. The lock mechanism of claim 14, wherein:

the second portion of the protrusion is positioned forward of the first portion.

18. The lock mechanism of claim 14, wherein:

the protrusion further has a third portion, the third portion configured to extend through the passage of the floor plate and protrude from the proximal side of the floor plate.

19. The lock mechanism of claim 18, wherein:

the first portion of the protrusion is positioned between the second portion and the third portion.

20. The lock mechanism of claim 18, wherein:

the first portion and the third portion are separated by a surface that is parallel to neither the first portion nor the third portion.

* * * * *